United States Patent [19]

Pasko, Jr. et al.

[11] Patent Number: 4,520,556

[45] Date of Patent: Jun. 4, 1985

[54] METHODS FOR ASSEMBLING A TRANSFORMER CORE

[75] Inventors: Walter J. Pasko, Jr., Lee; William H. Rathbun, Pittsfield, both of Mass.

[73] Assignee: General Electric Company, King of Prussia, Pa.

[21] Appl. No.: 524,495

[22] Filed: Aug. 18, 1983

Related U.S. Application Data

[62] Division of Ser. No. 260,023, May 4, 1981, abandoned.

[51] Int. Cl.[3] ..... H01F 7/06

[52] U.S. Cl. ..... 29/606; 29/609; 336/212; 336/217; 336/234

[58] Field of Search ..... 29/602 R, 606, 609; 336/216, 217, 218, 212, 233, 234

[56] References Cited

U.S. PATENT DOCUMENTS

| | | | |
|---|---|---|---|
| 2,792,554 | 5/1957 | Graham | 336/217 |
| 2,922,972 | 1/1960 | Gordy | 336/217 X |
| 3,252,119 | 5/1966 | Graham | 336/216 X |
| 3,546,645 | 12/1970 | Frowein | 336/217 X |

FOREIGN PATENT DOCUMENTS

| | | | |
|---|---|---|---|
| 1126338 | 7/1956 | France | 336/217 |

*Primary Examiner*—Carl E. Hall

*Attorney, Agent, or Firm*—William Freedman; Robert A. Cahill

[57] ABSTRACT

Power Transformer cores are assembled by inserting a plurality of lamination inserts between the upper yoke laminations and the leg laminations in the transformer core assembly process. The arrangement allows the upper yoke to be readily removed for inserting the transformer windings over the core legs. The upper yoke is then reassembled with the inserts reinserted to complete the transformer core.

2 Claims, 8 Drawing Figures

METHODS FOR ASSEMBLING A TRANSFORMER CORE

This is a division of application Ser. No. 260,023, filed May 4, 1981, abandoned.

BACKGROUND OF THE INVENTION

Transformer cores for large power transformers are assembled by arranging a plurality of core steel laminations in a core bottom yoke and core leg arrangement in the horizontal plane. When the three-phase core is to be assembled, the three legs and the bottom yoke that interconnects the three legs are assembled in a stack of core steel laminations that are bound together by any of several means, for instance, by the use of an epoxy impregnated glass tape. The assembled core legs and bottom core yoke are then raised to a vertical position for ease in assembling the transformer windings around each of the core legs. Once the transformer windings are in place, the transformer core is completed by inserting the upper yoke core steel laminations and fastening the laminations together by means of a clamping structure. The placement of a plurality of core steel laminations upon the partially completed core assembly is a difficult and time consuming task to be performed in the latter stages of transformer manufacture. It is therefore desirable to be able to limit the amount of time required to assemble the core yoke laminations at a time in the transformer manufacturing process when the transformer is near completion. The purpose of this invention is to provide a method and means for assembling the upper core yoke as a single unitary assembly at a substantial saving in assembly time and cost.

SUMMARY OF THE INVENTION

A plurality of inserts are employed between the upper yoke laminations and core leg laminations in a transformer core assembly process. The inserts allow removal of the upper core yoke as a single unit to facilitate the placement of the transformer winding on the core legs. The core yoke unit is reassembled and the inserts are reinserted to complete the transformer core.

DESCRIPTION OF THE PREFERRED EMBODIMENT

Figure 1A:
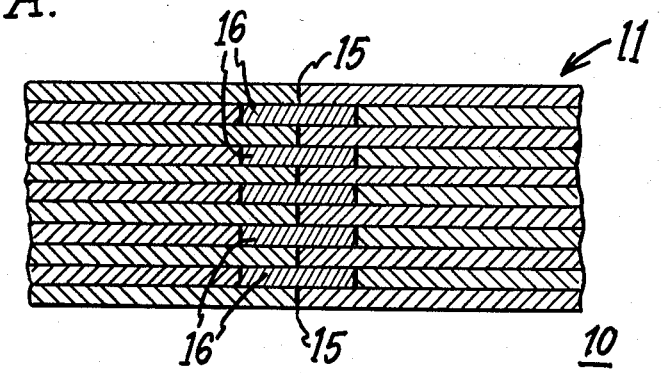
FIG. 1A is a cross-sectional view of a portion of the transformer core-leg interface depicted along the plane 1A—1A of the transformer depicted in FIG. 1.
Figure 1:
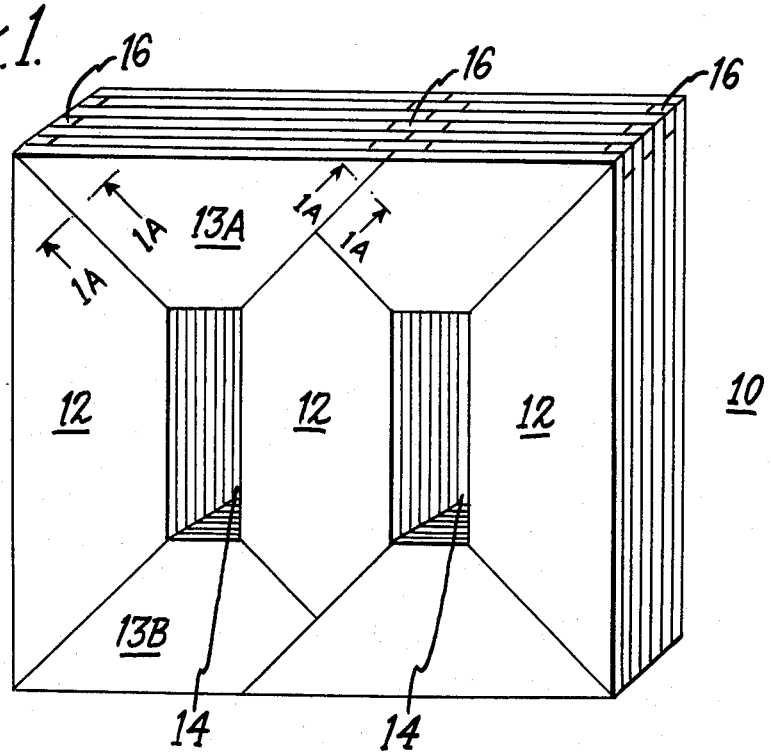
FIG. 1 is a front perspective view of a transformer core containing a yoke assembly according to the invention.

FIG. 1 contains a transformer core 10 containing a plurality of core steel laminations 11 which can consist of one or more sheets of core steel material in a three-phase configuration containing three core legs 12 and top and bottom yokes 13A, 13B. A pair of core windows 14 are defined between core legs 12 and yokes 13A, 13B to provide for the arrangement of three transformer windings. Within the corners, defined by the plane 1A—1A between legs 12 and top yoke 13A are inserted a plurality of inserts 16 shown in FIG. 1A. A stack of laminations 11 are arranged such that every other pair of laminations 11 in the stack contact each other at a boundary 15. Insert 16 comprising a length of core steel lamination material having a thickness equal to an individual lamination 11 is provided between opposing laminations 11 as indicated. Insert 16 can be readily removed from the stack of laminations 11 after the stack has been completed. Insert 16 provides two important functions, namely, providing for removal of top yoke 13A from core legs 12 as well as preventing boundaries 15 from directly aligning above each lamination 11 in the stack. The nonalignment of boundaries 15 prevents the occurrence of eddy losses between subjacent laminations 11 in the stack and provides a path across the joint for the transfer of magnetic flux between yokes 13 and legs 12. In the assembly of core 10, depicted in FIG. 1, a plurality of laminations 11 are arranged to form bottom yoke 13B and legs 12. Core laminations 11 are arranged with their major dimensions in a horizontal plane such that once core 10 is assembled it can be raised into the vertical position shown in FIG. 1. Once legs 12 and bottom yoke 13B are assembled they are physically and mechanically clamped or bonded by the arrangement of a plurality of turns of glass tape 17 impregnated with a heat curable epoxy resin (FIG. 4) or by means of a core clamp. Top yoke 13A containing a plurality of inserts 16 is bonded or clamped only at its central portion and does not contain any glass tape, for example, near the interface between top yoke 13A and legs 12. Inserts 16 are now removed to allow top yoke 13A to be removed as a single integral unit. As described earlier, top yoke 13A according to the prior art, was not assembled at the time that bottom yoke 13B and legs 12 were assembled in order to provide for the arrangement of transformer winding 18 (FIG. 5) around core leg 12. Laminations 11 used to form top yoke 13A were then individually inserted after the placement of transformer winding 18 to complete core 10.

Figure 2:
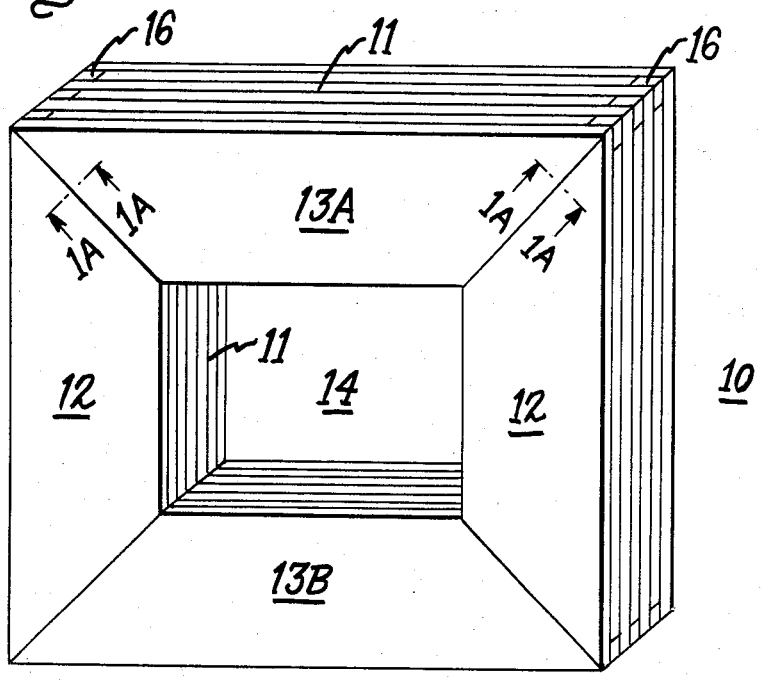
FIG. 2 is a top perspective view of a single-phase transformer winding according to the invention.

FIG. 2 shows a single-phase arrangement of a transformer core 10 having two legs 12 and a top and bottom yoke 13A, consisting of laminations 11 and defining core window 14. Top yoke 13A and bottom yoke 13B can consist of a single structure rather than the two-part assembly of top and bottom core yokes 13A, 13B shown earlier in FIG. 1. Inserts 16 are provided between the ends of top yoke 13A and core legs 12 in the same manner as shown for FIG. 1.

Figure 3:
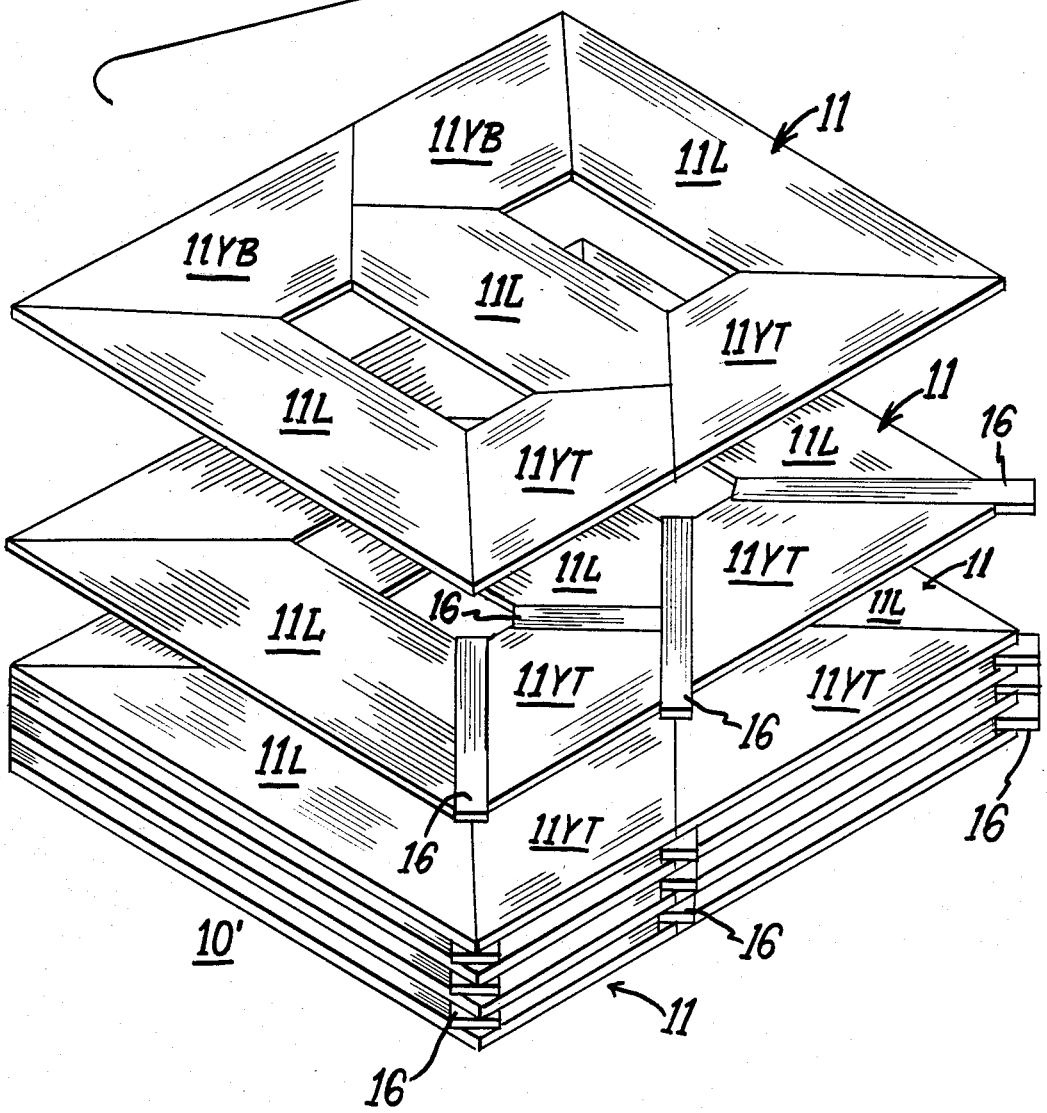
FIG. 3 is a top perspective view in isometric projection of the core and coil assembly utilized in the transformer shown in FIG. 1.
Figure 4:
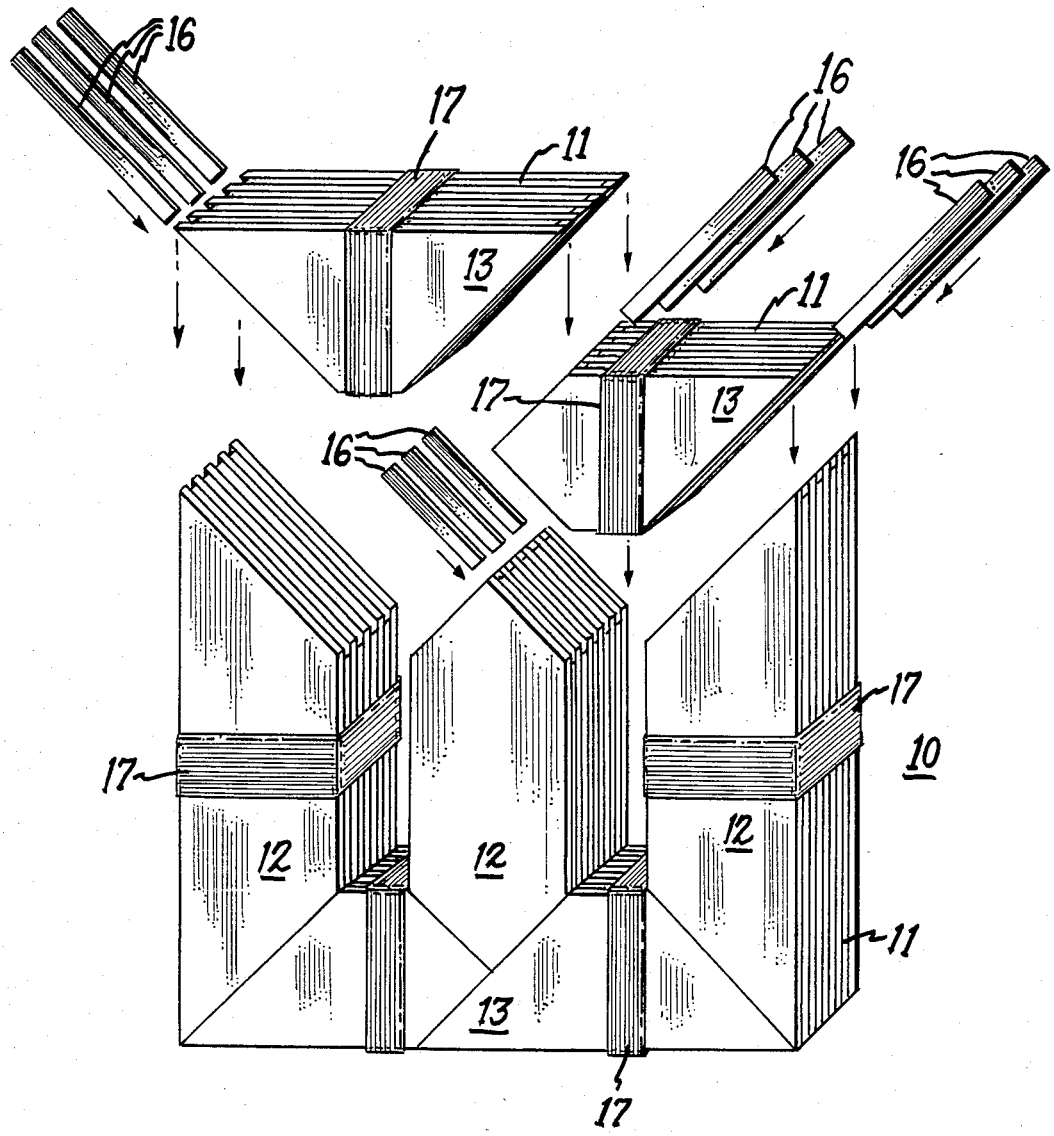
FIG. 4 is a front perspective view in isometric projection of the inserts of the instant invention shown subsequent to removal from a top yoke assembly according to the instant invention.

The assembly arrangement of core 10, shown in FIG. 1, is shown in enlarged isometric projection in FIG. 3. To distinguish between the finished core 10 shown in FIG. 1, the core assembly depicted in FIG. 3 is designated 10'. Since a plurality of laminations 11 are employed within core assembly 10', the laminations comprising the core legs are designated 11L, the laminations comprising the top yoke are designated 11YT and the laminations comprising the bottom yoke are designated 11YB. Inserts 16 are included within every other layer as shown. Since the top yoke 13A, of FIG. 1, is to be removed, inserts 16 are shown in FIG. 3 only with top yoke laminations 11YT. Inserts 16 can be included between bottom yoke laminations 11YL and leg laminations 11L if removal of bottom yoke 13B (FIG. 1A) is desired. Inserts 16 are included at the corner formed between a leg core lamination 11L and an adjacent top yoke core lamination 11YT at both corners. Once core assembly 10' is completed, a clamping structure or an epoxy impregnated glass tape 17 is used to mechanically secure bottom yoke laminations 11YB, yoke leg laminations 11L, and top yoke laminations 11YT. In addition, epoxy resin may be applied to the edges of yoke laminations 11YT, 11YB to prevent displacement. After being mechanically bonded, core assembly 10' becomes a completed transformer core 10 and is raised to its vertical position as shown in FIG. 4. In order to remove top yoke 13A from transformer core 10 inserts 16 are removed and top yoke 13A is removed from core 10 as a single unit. The epoxy impregnated glass bonding tape 17 holds the remaining core legs 12 and bottom yoke 13B fixedly attached. Transformer windings 18 are then centered around legs 12 and top yoke 13A is then reassembled by bringing top yoke 13A into contact with transformer legs 12 and reinserting inserts 16 which then become a physical portion of core 10 and provide a magnetic link between individual laminations 11.

Figure 5:
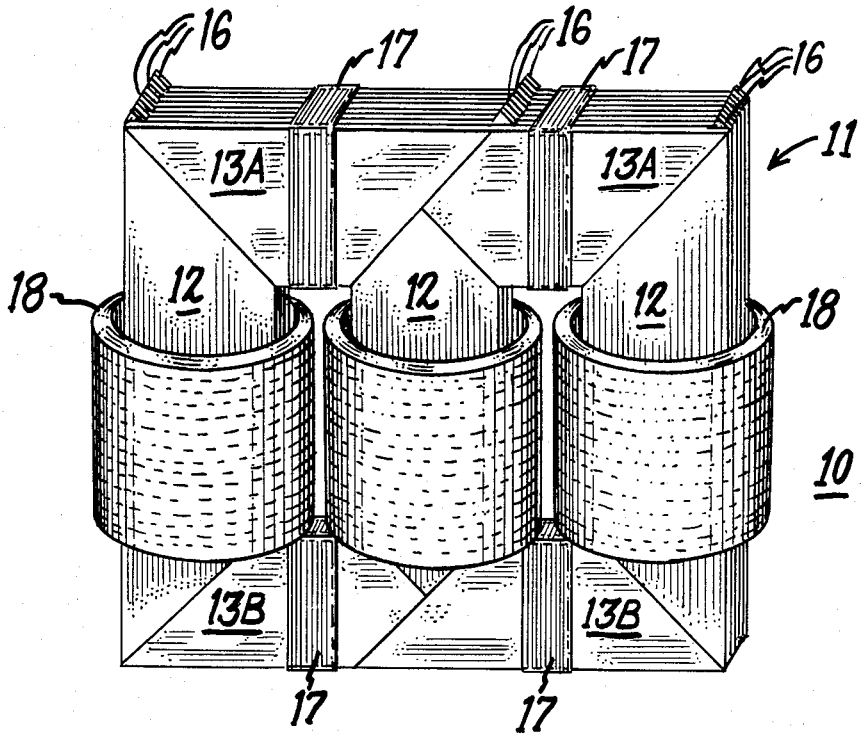
FIG. 5 is a front perspective view of the transformer depicted in FIG. 4 after installing the transformer windings and the top transformer yoke unit.

A completed core 10 is shown in FIG. 5 with windings 18 surrounding core legs 12 and with top yoke 13A and bottom yoke 13B firmly in place. Inserts 16 provide a useful function in the event that windings 18 become damaged during the operating life of the transformer and must be removed for replacement and/or repair. Inserts 16 are then removed and top yoke 13A is removed as a single unit without damaging core 10.

Figure 6:
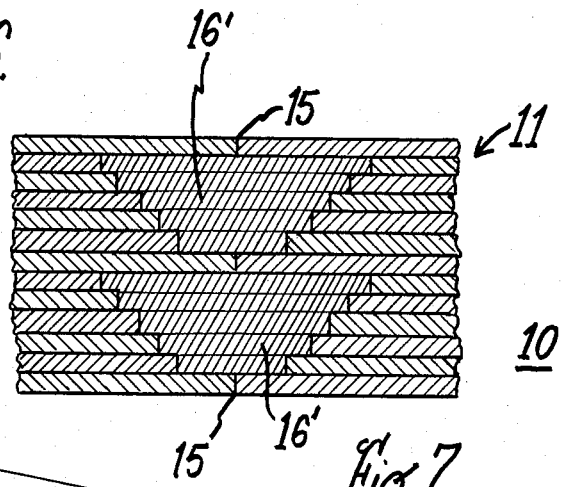
FIG. 6 is a cross-sectional view of an alternate insert configuration according to the instant invention.
Figure 7:
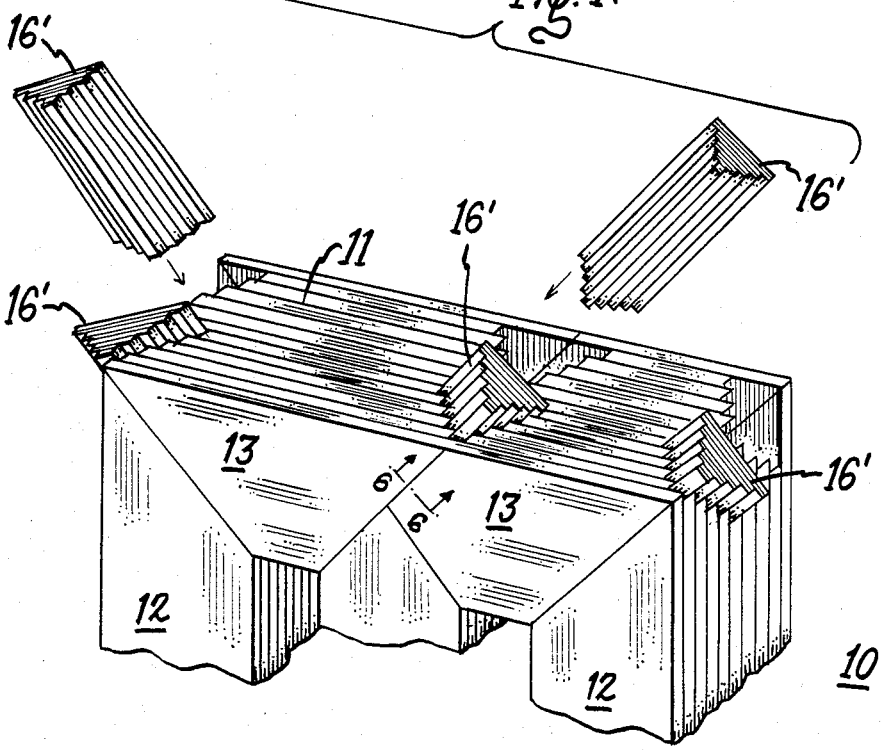
FIG. 7 is a top perspective view including a partial cutaway section of a transformer top yoke containing inserts shown in FIG. 6 in isometric projection and depicting the 6—6 plane which includes the inserts depicted in FIG. 6.

FIG. 6 contains an alternate arrangement for inserts 16 which are attached together to form an insert assembly 16'. As described earlier for the embodiment depicted in FIG. 2, adjacent pairs of laminations 11 meet at a joint 15 and insure that subjacent joints 15 do not directly overlap to prevent eddy current loss. Insert assembly 16' can provide a stepped core joint configuration wherein successive layers of laminations 11 are offset by a fixed increment to further reduce core loss. Providing insert assembly 16', in the manner depicted in FIG. 6, imparts an accurate stepped lap configuration to core 10 by providing a stop for each individual lamination 11 resulting in the configuration shown. Insert assembly 16' is inserted within transformer core in a manner similar to that described earlier for the configuration depicted in FIG. 4 and is shown in a similar assembly arrangement in FIG. 7. Insert assembly 16' is shown both in place within transformer core 10 as well as prior to insertion within core 10 to show the stepped relation between individual laminations 11.

The prior art assembly of top yoke 13A was deferred until transformer windings 18 were installed on the core 10, at which time the assembly of core laminations 11 to form top yoke 13A was performed at a later stage in the transformer manufacturing process after a large amount of time and expense had already accrued. From a manufacturing cost standpoint, the provision of a plurality of inserts 16 allowing for the assembly of laminations 11 to form upper core yoke 13A in the early stages of the transformer manufacturing process is highly beneficial and desirable. The reassembly of top yoke 13A, as a single unit in the later stages of transformer manufacture, is a relatively simple procedure that does not require a great deal of manufacturing time.

We claim:

1. A method for creating a transformer core and winding assembly comprising the steps of:

arranging a plurality of core leg laminations and bottom core yoke laminations to form at least a pair of core legs having a bottom interconnecting core yoke, all lying in a horizontal plane;

assembling a plurality of top core yoke laminations extending between open ends of said transformer core legs to form a top core yoke and a magnetic path between said transformer core legs and said transformer top and bottom core yokes;

assembling a plurality of core steel inserts in corners formed by said core legs and said top core yoke to complete said magnetic path;

mechanically fastening together the respective laminations of said transformer core legs and the respective laminations of said transformer top and bottom core yokes;

raising said fastened core legs and said fastened top and bottom core yokes together to a standing position with said transformer legs extending in a vertical plane;

removing said fastened transformer top core yoke as a unit and said inserts to provide access to said transformer core legs;

arranging a transformer winding around at least one of said transformer core legs; and reassembling said fastened transformer top core yoke as a unit and said inserts intermediate said transformer core legs to recomplete said magnetic path.

2. The method of claim 1 including the step of inserting said inserts between every other one of said core legs and said top core yoke laminations.

* * * * *